US005440373A

United States Patent [19]

Deki et al.

[11] Patent Number: 5,440,373

[45] Date of Patent: Aug. 8, 1995

[54] COLOR IMAGE FORMING APPARATUS

[75] Inventors: Tsuyoshi Deki, Kawasaki; Minoru Suzuki, Yokohama; Koji Sakamoto; Koichi Noguchi, both of Tokyo; Hiroyuki Matsushiro, Yokohama; Eiichi Sasaki, Sagamihara; Noriyuki Kimura, Kawasaki; Takatsugu Fujishiro; Chiyako Hatsuyama, both of Tokyo, all of Japan

[73] Assignee: Ricoh Company, Ltd., Tokyo, Japan

[21] Appl. No.: 302,957

[22] Filed: Sep. 12, 1994

Related U.S. Application Data

[63] Continuation of Ser. No. 125,766, Sep. 24, 1993, abandoned.

[30] Foreign Application Priority Data

Sep. 25, 1992 [JP] Japan ..... 4-256180

[51] Int. Cl.[6] ..... G03G 15/00

[52] U.S. Cl. ..... 355/210; 355/200; 355/326 R

[58] Field of Search ..... 355/210, 200, 326 R, 355/327, 271, 326

[56] References Cited

U.S. PATENT DOCUMENTS

| | | | |
|---|---|---|---|
| 5,089,846 | 2/1992 | Tabuchi | 355/200 |
| 5,103,260 | 4/1992 | Tompkins et al. | 355/326 X |
| 5,103,261 | 4/1992 | Matsuo et al. | 355/210 |
| 5,138,372 | 8/1992 | DeCecca | 355/200 |
| 5,196,884 | 3/1993 | Sugiyama et al. | 355/200 |
| 5,210,576 | 5/1993 | Haneda et al. | 355/271 |
| 5,325,151 | 6/1994 | Kimura et al. | 355/200 |
| 5,327,208 | 7/1994 | Matsuo et al. | 355/326 R |

FOREIGN PATENT DOCUMENTS

| | | | |
|---|---|---|---|
| 0513547 | 11/1992 | European Pat. Off. | 355/326 |
| 0198774 | 8/1989 | Japan | 355/326 |
| 0167575 | 6/1990 | Japan | 355/327 |
| 0294673 | 12/1990 | Japan | 355/326 |
| 0005669 | 1/1992 | Japan | 355/327 |
| 0199164 | 7/1992 | Japan | 355/326 |

*Primary Examiner*—Matthew S. Smith

*Attorney, Agent, or Firm*—Oblon, Spivak, McClelland, Maier & Neustadt

[57] ABSTRACT

An electrophotographic color image forming apparatus is disclosed which allows a photoconductive element and an intermediate transfer belt, which are expendables, to be removed from the body thereof at the same time. This promotes easy replacement, inspection and so forth of expendables. The photoconductive element and intermediate transfer belt can be replaced substantially at the same period, reducing the frequency of replacement of expendables. A cartridge including the photoconductive element can be replaced with a minimum of component parts wasted, thereby enhancing the cost performance of the apparatus. Moreover, when a cover hinged to the body of the apparatus is opened, various units can be removed one after another, a unit around which the greatest space is available being first.

11 Claims, 9 Drawing Sheets

COLOR IMAGE FORMING APPARATUS

This application is a Continuation of application Ser. No. 08/125,766, filed on Sep. 24, 1993, now abandoned.

BACKGROUND OF THE INVENTION

The present invention relates to a color copier, color printer, color facsimile machine or similar electrophotographic color image forming apparatus.

Predominant color image forming apparatuses available today are generally classified into two types, i.e., one which transfers monocolor images formed on a photoconductive drum sequentially to a sheet one over the other, and the other which forms a composite color image on the drum and then transfers it to a sheet collectively. The problem with the sequential transfer type apparatus is that when use is made of a postcard or similar sheet of small size or a thick sheet, it is difficult to wrap the sheet around a transfer drum. Therefore, the material and size of sheets applicable to this type of apparatus are limited. Another problem with such an apparatus is that the image forming area available for the sheet is narrow since the sheet wrapped around a transfer drum is usually clamped at the edge thereof. The other type of apparatus, i.e., collective transfer type apparatus is disclosed in Japanese Patent Laid-Open Publication No. 106557/1992 by way of example. This type of apparatus has a problem that the steps of charging the surface of the drum over a toner image formed thereon, exposing the drum and developing the resulting latent image have to be repeated a plurality of times, making it difficult to maintain chargeability constant. In addition, this type of apparatus is lower in image quality than the sequential transfer type apparatus using the transfer drum.

SUMMARY OF THE INVENTION

It is, therefore, an object of the present invention to provide a color image forming apparatus which allows a photoconductive element and an intermediate transfer belt, which are expendables, to be removed together from the body thereof, thereby promoting easy replacement, inspection and so forth.

A color image forming apparatus of the present invention comprises a photoconductive element, a latent image forming section for electrostatically forming latent images each being representative of an image of particular color on the photoconductive element, a developing device having a plurality of developing units each for developing one of the latent images with a developer of particular color, a movable support supporting the plurality of developing units and moving the plurality of developing units sequentially to a position where the plurality of developing units will sequentially face a developing position of the photoconductive element, an intermediate transfer belt rotatable in contact with the photoconductive element, a fixing device located downstream of the intermediate transfer belt in an intended direction of sheet transport, a photoconductive element cartridge in which at least the photoconductive element and intermediate transfer belt are mounted on a common support, a body supporting the latent image forming section, movable support, photoconductive element cartridge, and fixing device, and holding means provided on the body for removably holding the photoconductive element cartridge, developing device, and fixing device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
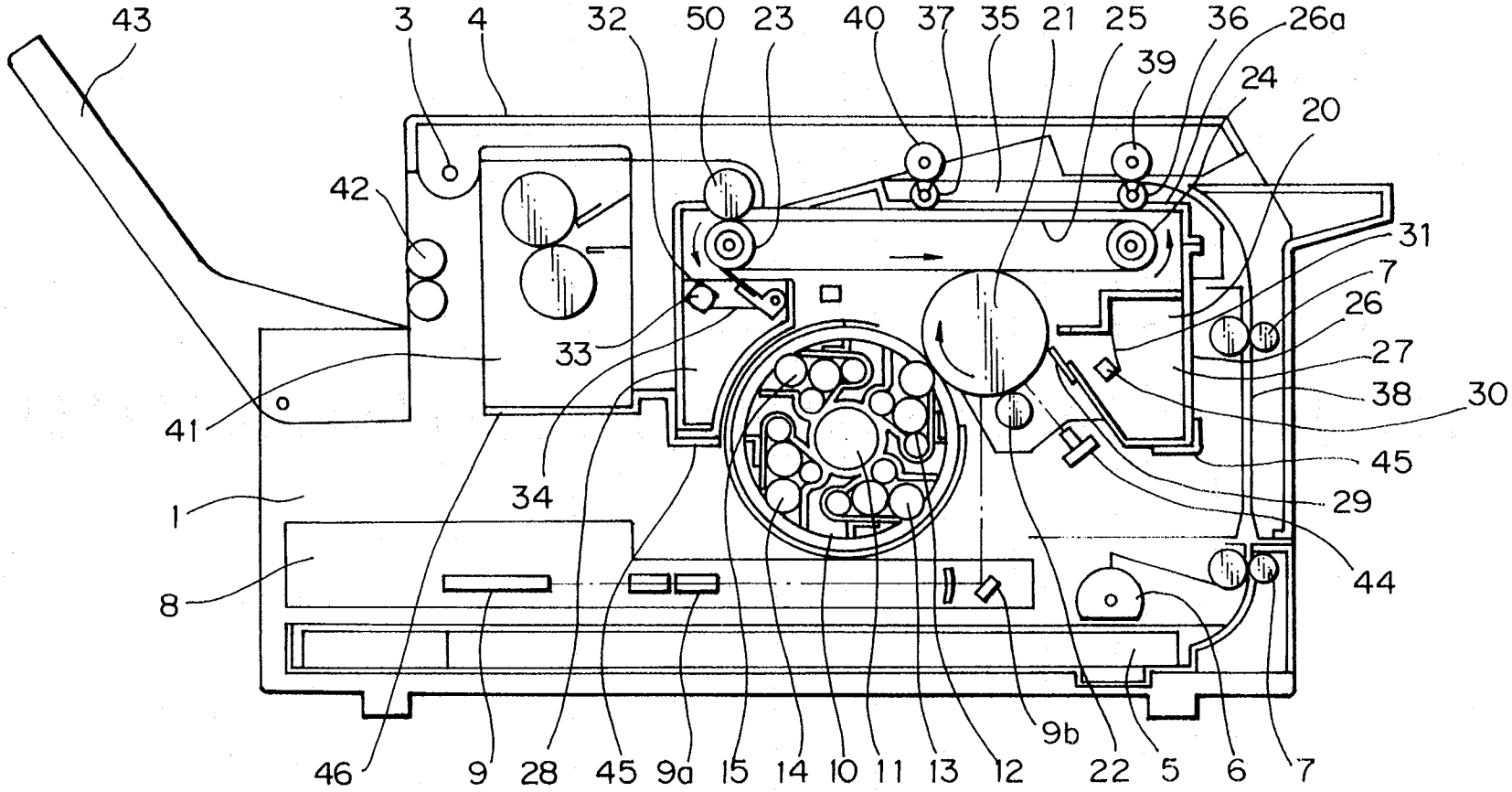
FIG. 1 is a sectional front view of a color image forming apparatus embodying the present invention.
Figure 2:
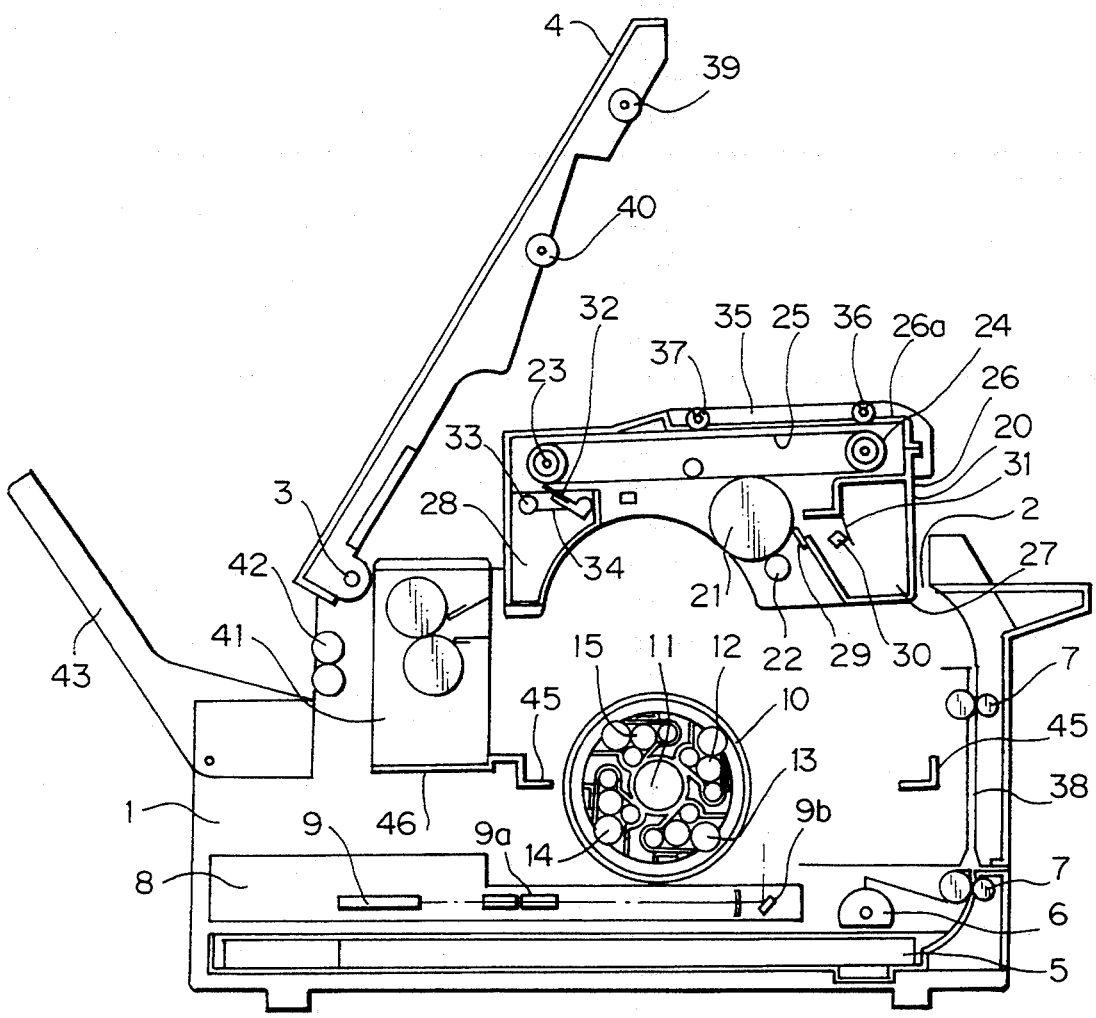
FIG. 2 is a view similar to FIG. 1, showing how a photoconductive element cartridge included in the embodiment is replaced.

Referring to FIGS. 1–7, a color image forming apparatus embodying the present invention is shown and includes a body 1. As shown in FIGS. 1 and 2, the body 1 is formed with an opening 2 at the top thereof. A cover 4 is rotatably supported by, or hinged to, the body 1 at one edge of the opening 2 via a shaft 3. Also mounted on the body 1 are a sheet cassette 5, a pick-up roller 6 for pulling sheets out of the cassette 5 one by one, a transport roller 7 for conveying the sheet pulled out by the pick-up roller 6, and latent image forming means 8. In the illustrative embodiment, the latent image forming means 8 is implemented by a laser for emitting a laser beam, a rotatable polygonal mirror 9 for steering the laser beam, an f-theta lens 9*a*, and a mirror 9*b*. The laser beam steered by the polygonal mirror 9 is projected onto a photoconductive element, which will be described, via the f-theta lens 9*a* and mirror 9*b*. Alternatively, the latent image forming means 8 may be constituted by the combination of light emitting elements and converging light conducting elements arranged on a line.

Figure 5:
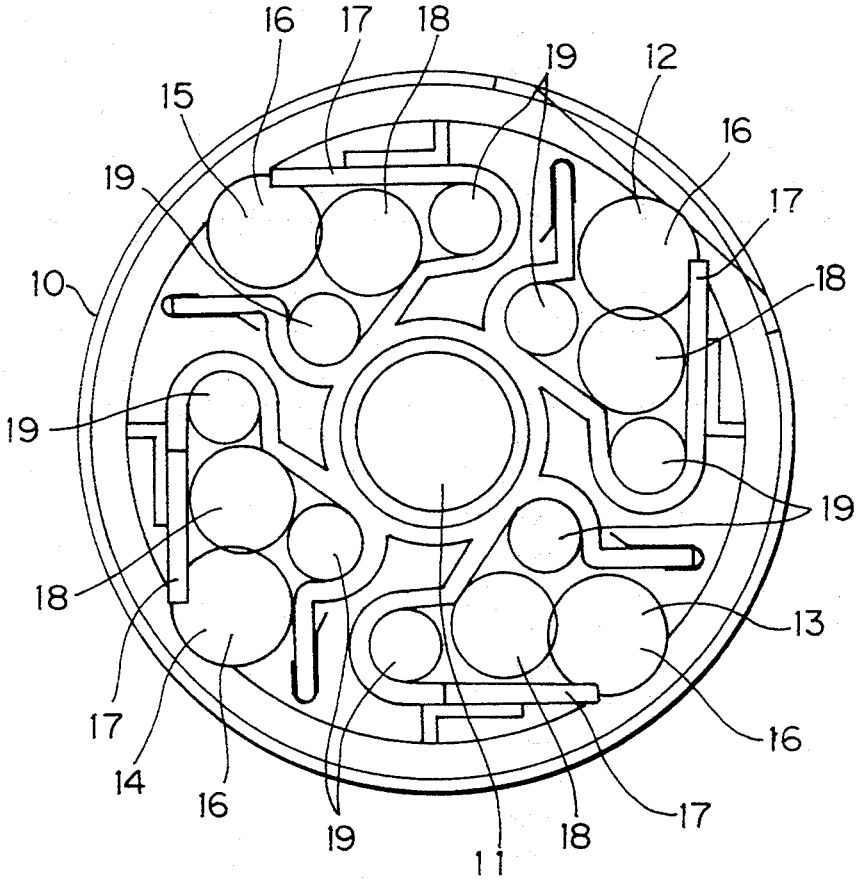
FIG. 5 is a sectional front view of the developing device.

A revolver type developing device 10 is disposed above the latent image forming means 8. The developing device or revolver 10 is made up of a plurality of (four in the embodiment) developing units 12, 13, 14 and 15 which are mounted on a shaft, or movable support, 11. The developing units 12–15 each stores a developer of particular color. As shown in FIG. 5, each of the developing units 12–15 has a developing roller 16, a regulating member 17 for regulating the amount of developer to deposit on the roller 16, a developer supply member 18, and an agitating member 19 for agitating the developer.

As shown in FIGS. 1 and 2, a photoconductive element cartridge 20 is located above the developing device 10. The cartridge 20 has a photoconductive element in the form of a drum 21, a charging member 22 held in contact with the drum 21, an intermediate transfer belt 25 passed over a drive roller 23 and a driven roller 24 and also held in contact with the drum 21, and a casing or support 26 supporting the members 21–25. A lid 26*a* is openably mounted on the top of the casing 26. The casing 26 has thereinside a space 27 for collecting a used toner from the drum 21, and a space 28 for collecting the used toner from the belt 25.

The toner collecting space 27 accommodates a cleaning blade 29 held in contact with the drum 21, a member 30 for driving the toner scraped off by the blade 29 into the space 27, and a member 31 for removing the toner deposited on the member 30. Likewise, the other toner collecting space 28 accommodates a cleaning blade 32 held in contact with the belt 25, a member 33 for driving the toner scraped off by the cleaning blade 32 into the space 28, and a member 34 for removing the toner deposited on the member 33.

As shown in FIGS. 1 and 2, a transport path is formed on the top of the lid 26*a* of the casing 26 to guide opposite edges of a sheet and is implemented by ribs. A transport roller 36 and a registration roller 37 are rotatably arranged on the transport path 35. The transport path 35 emerges from a sheet feed passage 38 which extends along one side of the body 1. A transport roller 39 and a registration roller 40 are rotatably mounted on the inner periphery of the cover 4 and held in contact with the above-mentioned transport roller 36 and the registration roller 37, respectively. A discharge lamp 44 is disposed in the cartridge 20 or in the casing 1 so as to dissipate the charge of the drum 21, as needed.

A fixing device 41, a discharge roller 42 and a tray 43 are also mounted on the body 1. The fixing device 41 fixes a toner image transferred from the belt 25 to a sheet being transported. The sheet having the image fixed thereon is driven out to the tray 43 by the discharge roller 42. A bracket 45 supporting the cartridge 20, a bracket, not shown, supporting the revolver 10, and a bracket 46 supporting the fixing device 41 extend out from the body 1. The brackets 45 and 46, as well as the bracket not shown, are positioned on the body 1 such that the cartridge 20, revolver 10 and fixing device 41 can be removed in this order; the cartridge 20 having a portion which is remotest from the shaft, or fulcrum, 3 supporting the cover 4.

Figure 6:
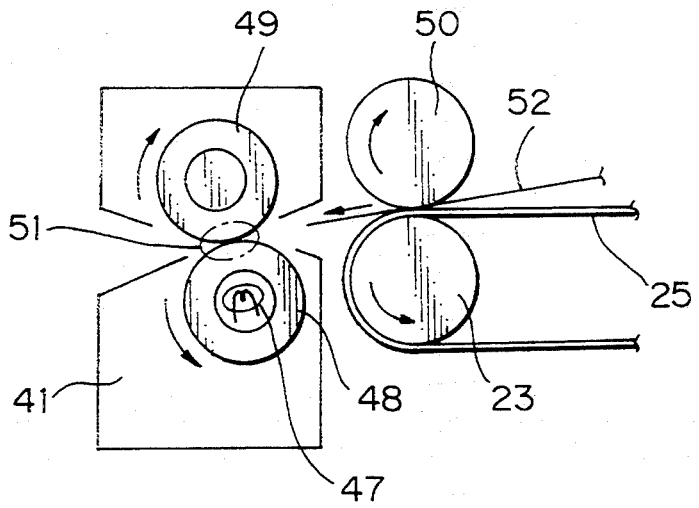
FIG. 6 is a fragmentary view representative of a relation between the fixing device and an intermediate transfer belt.

As shown in FIG. 6, the fixing device 41 has a heat roller 48 accommodating a halogen lamp or similar heat source 47 therein, and a press roller 49 pressed against the heat roller 48. A transfer member in the form of a roller 50 faces the drive roller 23 over which the intermediate transfer belt 25 is passed. The portion of the belt 25 intervening between the drive roller 23 and the transfer roller 50 is higher in level than the nip portion 51 of the heat roller 48 and press roller 49. It follows that a sheet 52 being conveyed by the belt 25 moves toward the nip portion 51 while bending downward due to gravity. This eliminates the need for a guide member otherwise provided between the belt 25 and the fixing device 41.

Figure 7:
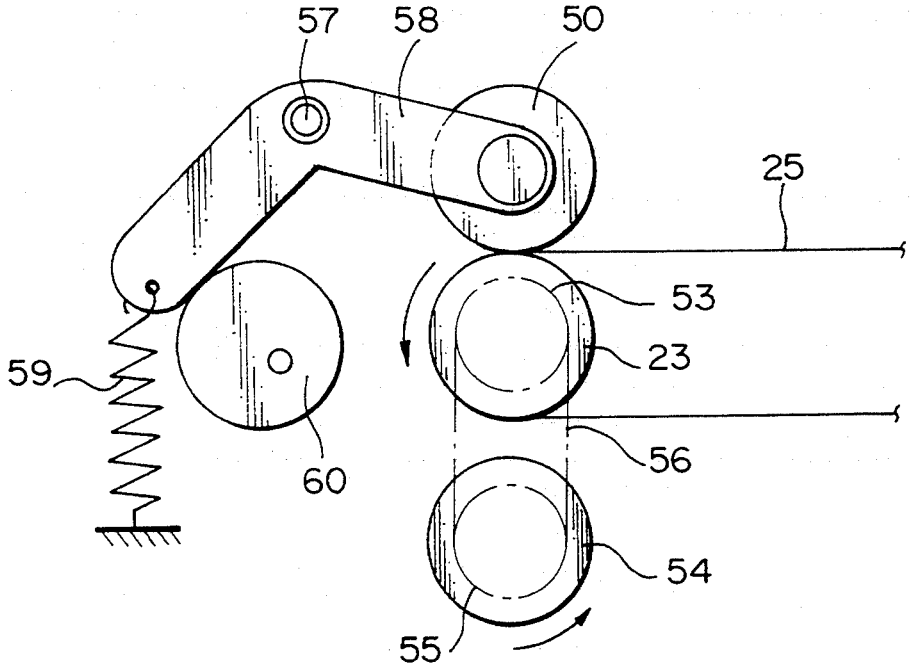
FIG. 7 is a fragmentary view representative of a relation between the intermediate transfer belt and a transfer member.

As shown in FIG. 7, a pulley 53 is rotatable integrally with the drive roller 23 while a pulley 55 is driven by a motor 54. The pulleys 53 and 55 are operatively connected together by a timing belt 56. An arm 58 is rotatable about a shaft 57 and constantly biased by a spring 59 in one direction. Carrying the transport roller 50 at one end, the arm 58 is held in contact with an eccentric cam 60 at the other end by the force of the spring 59.

In operation, an image data processing section processes data received from a color image inputting section to thereby generate image data, although not shown in the figures. The image data is once stored in a video memory, not shown, and applied to the latent image forming means 8 in the event of recording. In the latent image forming means 8, the polygonal mirror 9 is driven by a motor, not shown, to steer a laser beam issuing from a semiconductor laser. The laser beam is incident on the drum 21, which has been charged by the charging member 22 beforehand, via the f-theta lens 9*a* and mirror 9*b*. As a result, a latent image is electrostatically formed on the drum 21. In the illustrative embodiment, the image forming means 8 projects monocolor image patterns, i.e., yellow, magenta, cyan and black image patterns derived from a full-color image one after another onto the drum 21. The developing units 12–15 each develops one of the resulting latent images with the yellow, magenta, cyan or black developer stored therein. Specifically, the revolver 10 is rotated by the shaft 11 to bring the developing units 12–15 sequentially to a position where the developer should be supplied to the drum 21, thereby forming the monocolor images on the drum 21 one by one. While the drum 21 and the belt 25 are rotated clockwise and counterclockwise, respectively, the monocolor image is transferred from the drum 21 to the belt 25. This operation is repeated to transfer the yellow, magenta, cyan and black images to the belt 25 one above the other, whereby a full-color image is completed on the belt 25.

On the other hand, the sheet 52 fed from the sheet cassette 5 is driven from the transport passage 38 to the transport path 35 and then conveyed by the transport rollers 36 and 39 and register rollers 37 and 40. While the sheet 52 is in transport, the full-color image is transferred from the belt 25 to the sheet 52. The sheet 52 carrying the image thereon has the image fixed by the fixing unit 41. Finally, the sheet with the fixed image is driven out to the tray 43 by the discharge roller 42. At this instant, the image transfer from the belt 25 to the sheet 52 is effected on the drive roller 23 which exerts a rotating force on the belt 25. This allows the image to be transferred to the sheet 52 accurately at a predetermined position without being effected by, for example, a change in the tension of the belt 25. Of course, the transfer roller 50 may be replaced with a corona charger.

After the image transfer, the toner remains on the surface of the drum 21 and that of the belt 25. The cleaning blades 29 and 32 remove the toner from the drum 21 and the belt 25, respectively. The removed toner is collected in the spaces, or toner collecting sections, 27 and 28. Before the next image is formed on the drum 21, the discharge lamp 44 dissipates a charge remaining on the drum 21.

The drum 21 and belt 25, which are expendables, both are supported by the casing 26 of the cartridge 20 and removable from the body 1 together. This promotes easy replacement, inspection and so forth of expendables. The replacement or inspection can be done by opening the cover 4. If the drum 21 and belt 25 included in the cartridge 20 have substantially the same service life, they can be replaced substantially at the same period. This is successful in reducing the frequency of replacement of expendables. In addition, even the entire cartridge 20 can be replaced with a minimum of component parts wasted, enhancing the cost performance of the apparatus.

Figure 3:
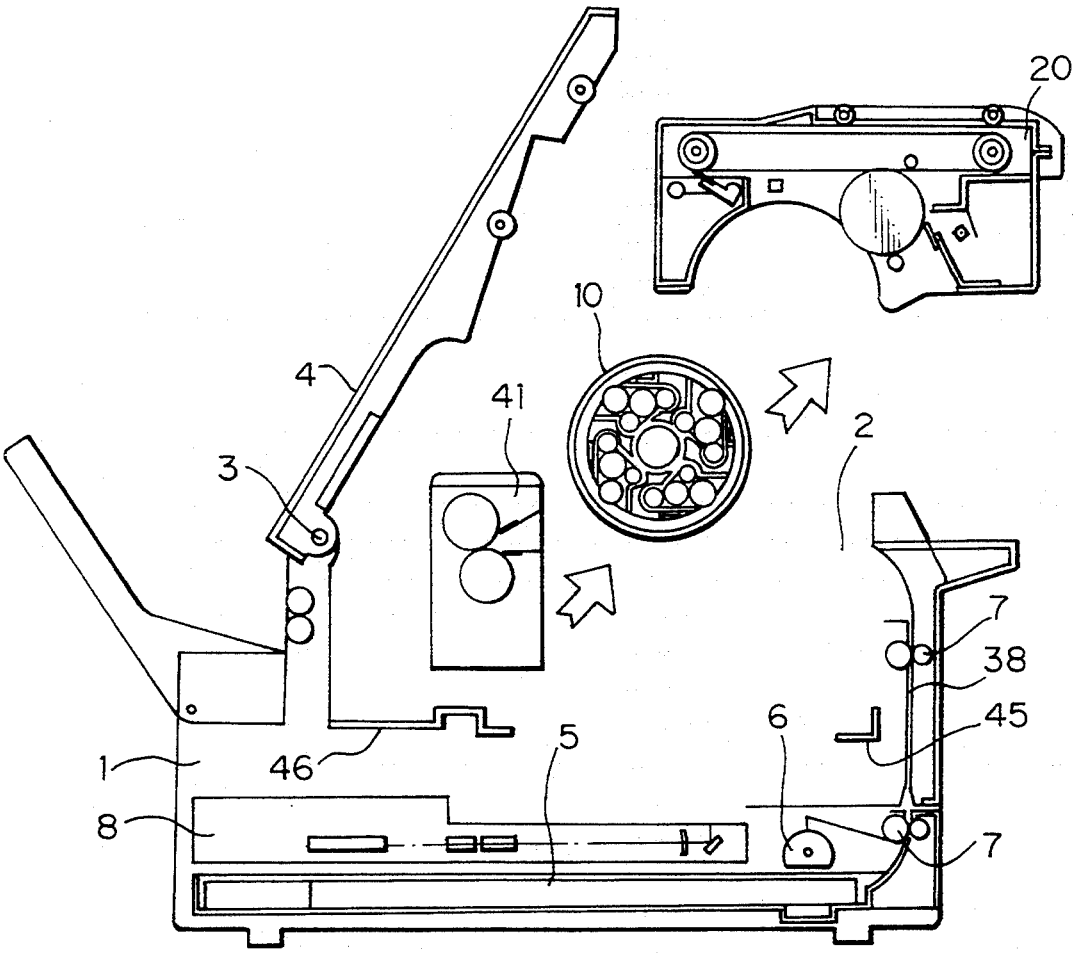
FIGS. 3 and 4 are sectional front views showing how the photoconductive element cartridge, a fixing device and a developing device are removed one after another.

The bracket 45 supporting the cartridge 20, the bracket, not shown, supporting the developing device 10, and the bracket 46 supporting the fixing device 41 are positioned such that the cartridge 20 remotest from the fulcrum 3 of the cover 4, developing unit 10, and fixing device 41 closest to the fulcrum 3 can be removed sequentially in this order, as stated earlier. Specifically, as shown in FIG. 3, when the cover 4 is opened, the cartridge 20, developing device 10 and fixing device 41 can be removed in this order; the space available for removal is greatest around the cartridge 20. As a result, easy maintenance is promoted.

Figure 4:
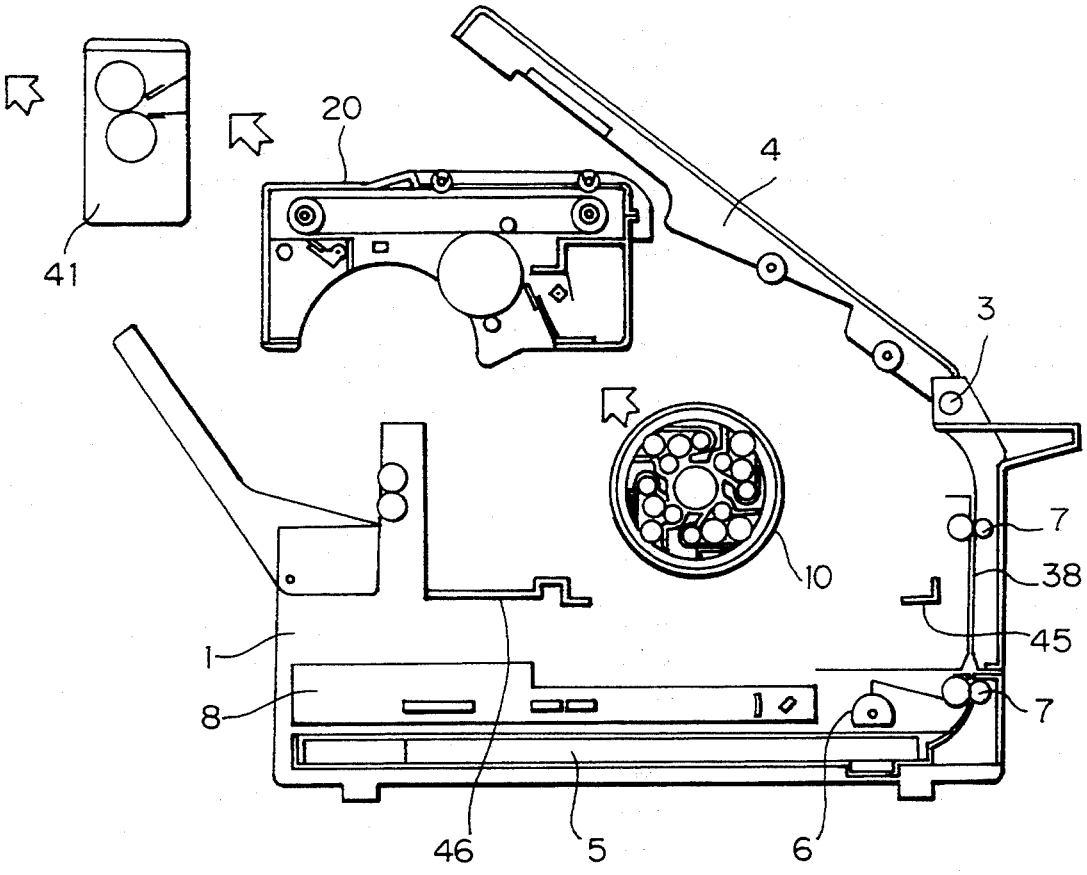

As shown in FIG. 4, assume that the fulcrum 3 of the cover 4 is positioned at the right-hand side of the body 1. Then, the fixing device 41, cartridge 20 and developing device 10 will be removed sequentially in this order; the space available for removal is greatest around the fixing device 41.

Further, the revolver 10 is capable of switching the color for development rapidly. Moreover, the revolver 10 can be positioned relative to the drum 21 easily without resorting to any special positioning member. In addition, since the revolver 10 supplies the developer to the drum 21 in the first domain with respect to the axis thereof, the developer is scarcely caused to drop or fly around.

An alternative embodiment of the present invention will be described with reference to FIGS. 8–11. In the figures, the same or similar components as or to the components of the previous embodiment are designated by the same reference numerals, and a detailed description will not be made to avoid redundancy. As shown, the photoconductive element cartridge 20 has a photoconductive belt 61 in place of the photoconductive drum 21. The photoconductive belt 61 is passed over a drive roller 62 and a driven roller 63 and held in contact with the intermediate transfer belt 25 on the periphery of the driven roller 63. A bias roller 64 is provided for transferring a developed image from the belt 61 to the belt 25.

Figure 9:
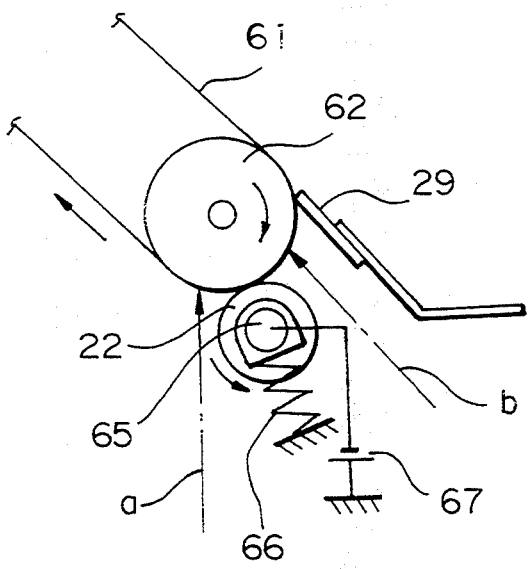
FIG. 9 is a front view representative of a relation between a photoconductive belt and a charging member included in the alternative embodiment.

As shown in FIG. 9, the charging member or charge roller 22 is rotatably supported by a bearing 65. A spring 66 constantly biases the bearing 65 such that the charge roller 22 remains in pressing contact with the photoconductive belt 61 on the periphery of the drive roller 62. The bearing 65 is connected to a power source 67. The latent image forming means 8 emits a laser beam a while the discharge lamp 44 emits light b.

Figure 10:
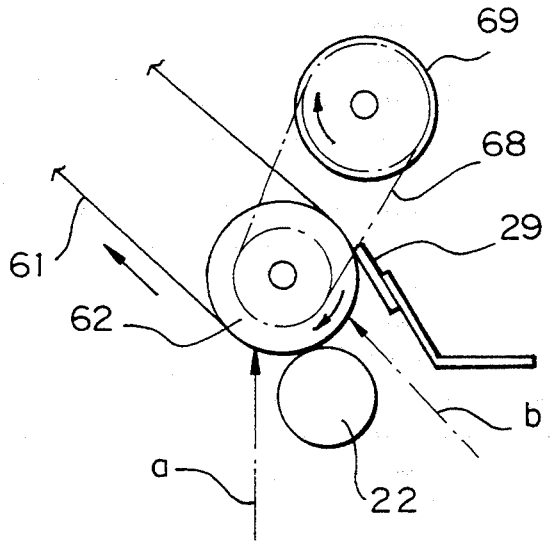
FIG. 10 is a front view of an arrangement for driving the photoconductive belt.

As shown in FIG. 10, the drive roller 62 is connected to a motor 69 by power transmitting means implemented as a timing belt 68. Alternatively, the power transmitting means may be constituted by a chain, gears, etc., if desired.

In operation, when the motor 69 is energized, it rotates the drive roller 62 together with the driven roller 63 and photoconductive belt 61. The belt 61 in turn rotates the charge roller 22 which is pressed against the belt 61. As a result, the charge roller 22 charges the belt 61 due to a voltage applied from the power source 67. The charged portion of the belt 61 is exposed by the laser beam a issuing from the latent image forming means 8. Only if the exposing position is located on the periphery of the drive roller 62, a latent image can be formed accurately at a predetermined position on the drive roller 62, although the tension of the belt 61, for example, may change. Furthermore, if all of the drive roller 62 and driven roller 63 over which the belt 61 is passed and the drive roller 23 and driven roller 24 over which the belt 25 is passed are provided with the same outside diameter, the irregularity in transfer position ascribable to the eccentricity of the rollers 23, 24, 62 and 63 will be minimized.

Figure 8:
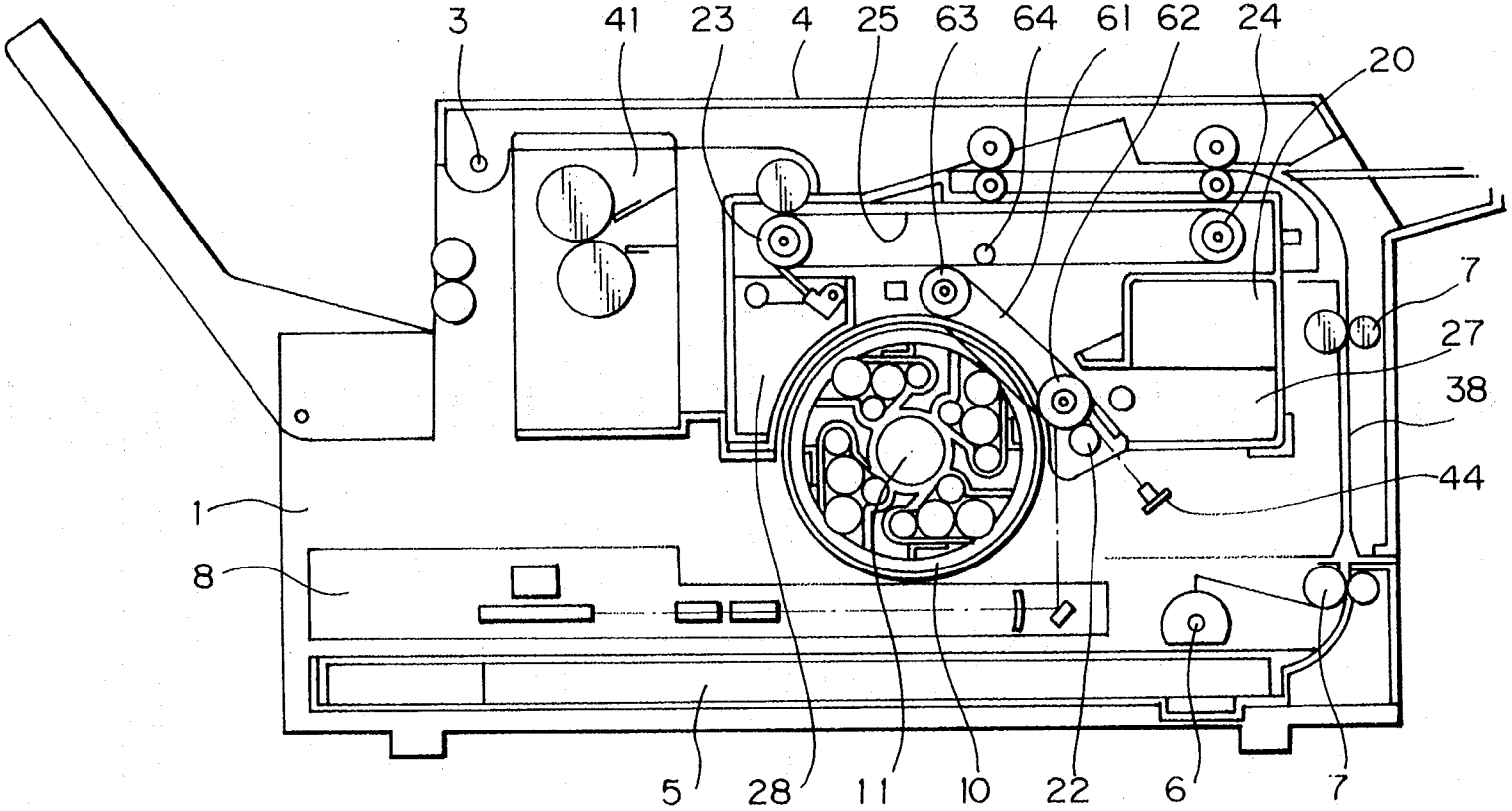
FIG. 8 is a sectional front view showing an alternative embodiment of the present invention.
Figure 11:
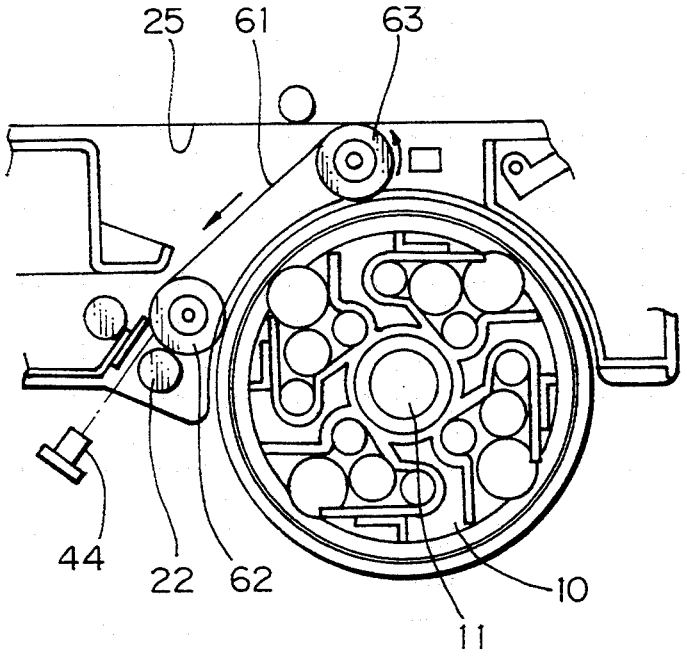
FIG. 11 is a sectional front view showing a modified relation between the photoconductive belt and the developing device.

As shown in FIG. 8, the revolver 10 supplies the developer to the photoconductive belt 61 in the first domain with respect to the axis thereof, as in the previous embodiment. This scarcely causes the developer to drop or fly away. This is also true when the relative position of the developing device 10 and photoconductive belt 61 is so changed as to supply the developer in the second domain of the device 10, as shown in FIG. 11.

In summary, it will be seen that the present invention provides a color image forming apparatus which allows a photoconductive element and an intermediate transfer belt, which are expendables, to be removed from the body thereof at the same time. This promotes easy replacement, inspection and so forth of expendables included in the apparatus. Since the photoconductive element and intermediate transfer belt can be replaced substantially at the same period, the frequency of replacement of expendables is reduced. At the same time, a cartridge including the photoconductive element can be replaced with a minimum of component parts wasted, thereby enhancing the cost performance of the apparatus. Moreover, when a cover is opened, various units can be removed one after another, a unit around which the greatest space is available being first. This is successful in promoting easy maintenance.

Various modifications will become possible for those skilled in the art after receiving the teachings of the present disclosure without departing from the scope thereof.

What is claimed is:

1. An image forming apparatus comprising:

a body whose upper portion is openable;

a photoconductive element;

a charger adjacent to said photoconductive element; exposing means;

a developing device;

image transferring means located above said photoconductive element;

a photoconductive element cartridge for supporting both of said photoconductive element and said image transferring means within said photoconductive element cartridge, a top portion of said photoconductive element cartridge comprising first transport rollers;

cleaning means; and image fixing means;

said body having second transport rollers in the openable upper portion thereof which correspond to the first transport rollers on the top portion of the photoconductive element cartridge, said openable upper portion of said body uncovering a sheet transport path defined on the top portion of said photoconductive element cartridge when said upper portion is opened;

at least said image transferring means and said photoconductive element being removably supported by said body;

said image transferring means and said photoconductive element being each mounted and dismounted in an up-and-down direction of said apparatus, wherein when said upper portion of said body is opened, a space for mounting and dismounting said image transferring means and said photoconductive element is formed.

2. An apparatus as claimed in claim 1, wherein said photoconductive element and said image transferring means have the same service life.

3. An apparatus as claimed in claim 1, wherein said body is formed with an opening at one surface thereof, and said openable upper portion of said body defines a cover hinged to said body at one edge of said opening.

4. An apparatus as claimed in claim 3, wherein said developing device comprises a revolver type developing device.

5. An apparatus as claimed in claim 4, further comprising holding means including a plurality of brackets provided on said body for removably supporting said photoconductive element cartridge, said developing device, and said image fixing means.

6. An apparatus as claimed in claim 5, wherein said photoconductive element cartridge, said developing device and said image fixing means are removed sequentially in a predetermined order away from a point where said cover is hinged to said body.

7. An apparatus as claimed in claim 1, wherein said openable upper portion of said body defines a cover hinged to said body at one end.

8. A color image forming apparatus comprising:

a body having an openable upper portion;

an intermediate transfer body on which a composite image is to be formed in a plurality of colors;

a cartridge including at least the intermediate transfer body; and image transferring means located above the intermediate transfer body for transferring the composite image to a sheet;

wherein:

the cartridge comprises at least one first transport roller at a top portion thereof for conveying the sheet to an image transfer position; and at least one second transport roller is located at said openable upper portion such that said openable upper portion uncovers a sheet transport path on said cartridge, which terminates at the image transfer position, when the openable upper portion is opened, and said second transport roller contacts said first transport roller when the openable upper portion is closed.

9. An apparatus as claimed in claim 8, wherein said intermediate transfer body and said image transferring means are disposed in said cartridge.

10. An apparatus according to claim 8, further including a developing device which comprises a revolver, wherein said cartridge is formed with a recess which is complementary to a contour of the revolver.

11. An apparatus according to claim 8, wherein when said cartridge is removed from said body, a space for removing the developing device is formed.

* * * * *